US010378422B2

(12) United States Patent
Kaneta et al.

(10) Patent No.: US 10,378,422 B2
(45) Date of Patent: Aug. 13, 2019

(54) THERMOSTAT ABNORMALITY DETERMINING DEVICE

(71) Applicant: HINO MOTORS, LTD., Tokyo (JP)

(72) Inventors: Motoyoshi Kaneta, Hino (JP); Hitoshi Nakano, Hino (JP)

(73) Assignee: HINO MOTORS, LTD., Tokyo (JP)

( * ) Notice: Subject to any disclaimer, the term of this patent is extended or adjusted under 35 U.S.C. 154(b) by 0 days.

(21) Appl. No.: 15/565,037

(22) PCT Filed: Feb. 26, 2016

(86) PCT No.: PCT/JP2016/055847

§ 371 (c)(1),
(2) Date: Oct. 6, 2017

(87) PCT Pub. No.: WO2016/189912

PCT Pub. Date: Dec. 1, 2016

(65) Prior Publication Data

US 2018/0112585 A1 Apr. 26, 2018

(30) Foreign Application Priority Data

May 26, 2015 (JP) ..... 2015-106374

(51) Int. Cl.
*F01P 3/20* (2006.01)
*F01P 11/16* (2006.01)
*F01P 3/00* (2006.01)

(52) U.S. Cl.
CPC ..... *F01P 3/20* (2013.01); *F01P 11/16* (2013.01); *F01P 2003/001* (2013.01)

(58) Field of Classification Search
CPC .... F01P 11/16; F01P 2031/00; F01P 2037/02; F01P 11/14; F01P 2031/32; F01P 7/16;
(Continued)

(56) References Cited

U.S. PATENT DOCUMENTS 6,230,553 B1 * 5/2001 Uchiyama ..... F01P 11/16 73/114.68
6,279,390 B1 8/2001 Oka et al.
(Continued)

FOREIGN PATENT DOCUMENTS

JP H11117799 A 4/1999
JP H11159379 A 6/1999
(Continued)

OTHER PUBLICATIONS

International Search Report corresponding to PCT/JP2016/055847, dated May 6, 2016, 2 pages.
(Continued)

*Primary Examiner* — Long T Tran
(74) *Attorney, Agent, or Firm* — Kilpatrick Townsend & Stockton LLP

(57) ABSTRACT

This thermostat abnormality determining device includes a cooling water temperature sensor, an estimated temperature calculating unit and a determining unit. The cooling water temperature sensor detects the temperature of cooling water that cools an engine. The estimated temperature calculating unit calculates an estimated temperature, which is an estimated value of the temperature of the cooling water. The determining unit determines if the thermostat has become stuck open after warming-up of the engine is complete. The criteria whereby the determining unit determines that the thermostat has become stuck open are that the estimated temperature is higher than a stuck-open determining temperature, which is a temperature lower than a warm-up completion temperature indicating that warming-up of the engine is complete, and that the cooling water temperature, which is the value detected by the cooling water temperature sensor, has been continuously at or below the stuck-open determining temperature for a determination period.

4 Claims, 3 Drawing Sheets

(58) Field of Classification Search
CPC ..... F02D 41/22; F02D 41/06; F02D 41/068; F02D 41/222
See application file for complete search history.

(56) References Cited

U.S. PATENT DOCUMENTS

| | | | | |
|---|---|---|---|---|
| 7,261,067 | B2 * | 8/2007 | Kim | F01P 5/14 123/41.15 |
| 9,091,600 | B2 * | 7/2015 | Senoo | G01K 7/42 |
| 9,448,194 | B2 * | 9/2016 | Furuta | G01N 25/72 |
| 9,605,584 | B2 * | 3/2017 | Nethercutt | F01P 7/16 |
| 2004/0168510 | A1 * | 9/2004 | Wakahara | F01P 11/14 73/114.71 |
| 2004/0181333 | A1 * | 9/2004 | Tsukannoto | F01P 11/16 701/114 |
| 2010/0095909 | A1 * | 4/2010 | Lin | F01P 11/16 123/41.02 |
| 2012/0106590 | A1 * | 5/2012 | Suzuki | F01P 11/16 374/1 |
| 2013/0255605 | A1 * | 10/2013 | Jentz | F01P 11/16 123/41.15 |
| 2014/0023107 | A1 | 1/2014 | Furuta et al. | |
| 2016/0326944 | A1 * | 11/2016 | Arslanturk | F01P 11/16 |

FOREIGN PATENT DOCUMENTS

| | | | |
|---|---|---|---|
| JP | 2012127324 | A | 7/2012 |
| JP | 2014020346 | A | 2/2014 |

OTHER PUBLICATIONS

Translation of International Preliminary Report on Patentability corresponding to PCT/JP2016/055847, dated Nov. 28, 2017, 92 pages.

* cited by examiner

THERMOSTAT ABNORMALITY DETERMINING DEVICE

TECHNICAL FIELD

The present invention relates to an abnormality determining device for a thermostat that is incorporated in the cooling circuit of an engine. The abnormality determining device determines whether the thermostat is stuck open.

BACKGROUND ART

A cooling circuit through which coolant for cooling the engine flows incorporates a thermostat that is opened or closed according to the temperature of the coolant. The thermostat opens the valve and allows the coolant to flow into a radiator when the temperature of the coolant is higher than or equal to a valve opening temperature. In relation to such a thermostat, Patent Document 1 discloses a technique of determining whether the thermostat is stuck open by comparing a coolant temperature detected by a coolant temperature sensor with an estimated temperature of the coolant temperature when warm-up of the engine is completed after the engine is started when it is cold.

PRIOR ART DOCUMENT

Patent Document

Patent Document 1: Japanese Laid-Open Patent Publication No. 2012-127324

SUMMARY OF THE INVENTION

Problem that the Invention is to Solve

In recent years, it has been also desired to determine whether a thermostat is stuck open after completion of warm-up of the engine. An objective of the present invention is to provide an abnormality determining device for a thermostat that allows determination of whether the thermostat is stuck open after completion of warm-up of the engine.

Means for Solving the Problems

To achieve the above objective, an abnormality determining device for a thermostat includes a coolant temperature sensor, an estimated temperature calculation section, and a determination section. The coolant temperature sensor detects a temperature of coolant for cooling an engine. The estimated temperature calculation section calculates an estimated temperature, which is an estimated value of the temperature of the coolant. The determination section determines that a thermostat is stuck open after completion of warm-up of the engine. The determination section determines that the thermostat is stuck open on condition that, the estimated temperature has been higher than a stuck-open state determination temperature that is lower than a warm-up completion temperature, which indicates completion of warm-up of the engine, and a coolant temperature, which is a detection value of the coolant temperature sensor, has been lower than or equal to the stuck-open state determination temperature for a determination period.

The valve opening temperature of the thermostat is set to a temperature higher than the warm-up completion temperature. Thus, after completion of warm-up of the engine, a state is easily maintained in which both the coolant temperature and the estimated temperature are higher than the warm-up completion temperature. Thus, after the completion of warm-up, a state in which the estimated temperature is higher than the stuck-open state determination temperature, which is lower than the warm-up completion temperature, and the coolant temperature is lower than or equal to the stuck-open state determination temperature is a state in which the coolant is excessively cooled. This excessive cooling of the coolant is caused by the thermostat being stuck open. According to the above configuration, after the completion of warm-up, the estimated temperature is higher than the stuck-open state determination temperature and a state in which the coolant temperature is lower than or equal to the stuck-open state determination temperature continues for a determination period. This allows for determination of whether the thermostat is stuck open after the completion of warm-up of the engine.

Preferably, the determination section has a suspension period for determining whether the condition is met. The suspension period is a period for which the estimated temperature is higher than the stuck-open state determination temperature and the coolant temperature continues to be lower than or equal to the stuck-open state determination temperature.

According to the configuration, it is not determined whether the condition is met until the estimated temperature is higher than the stuck-open state determination temperature and a state in which the coolant temperature is lower than or equal to the stuck-open state determination temperature has continued for the suspension period. This increases the reliability of the determination result of the determination section.

Preferably, the abnormality determining device for a thermostat further includes an ambient temperature sensor that detects an ambient temperature. The determination section holds a suspension period table that defines the suspension period for each ambient temperature and sets the suspension period according to the ambient temperature based on the suspension period table. The suspension period table defines the suspension period such that the lower the ambient temperature, the longer the suspension period becomes.

The lower the ambient temperature, the more easily the temperature of the coolant decreases and the less easily the temperature of the coolant increases. Thus, the above configuration, in which the lower the ambient temperature, the longer the suspension period becomes, further increases the reliability of the determination result of the determination section.

Preferably, the engine has an EGR device that causes some exhaust gas to circulate through an intake passage as EGR gas. The EGR device has an EGR cooler that cools the EGR gas with the coolant. The estimated temperature calculation section calculates a cylinder heat absorption amount, which is a heat absorption amount based on an engine speed, a fuel injection amount, an amount of working gas introduced to cylinders, a temperature of the working gas, and one of a density of the working gas and a density of exhaust gas in an exhaust manifold, calculates an EGR cooler heat absorption amount, which is a heat absorption amount based on a mass flow rate of the EGR gas and temperature change of the EGR gas in the EGR cooler, calculates an engine heat absorption amount, which is a heat absorption amount based on the engine speed, and calculates a block heat release amount, which is a heat release amount from an engine block based on a vehicle speed, an ambient temperature, a previous estimated temperature, and a surface area of the engine block. The estimated temperature calculation section calculates heat balance based on the cylinder heat absorption amount, the EGR cooler heat absorption amount, the engine heat absorption amount, and the block heat release amount. The estimated temperature calculation section calculates a temperature change amount of the coolant by dividing the heat balance by a value obtained by adding a heat capacity of the engine block to a heat capacity of the coolant.

According to the above configuration, the temperature change amount of the coolant is calculated based on the heat balance of the cylinder heat absorption amount, the EGR cooler heat absorption amount, the engine heat absorption amount, and the block heat release amount. This increases the accuracy of the estimated temperature.

Preferably, the estimated temperature calculation section calculates the estimated temperature while setting an upper limit value to an equilibrium temperature of the coolant when the thermostat is in an open valve state.

The thermostat operates such that the heat release amount by the radiator and various heat absorption amounts are in equilibrium. Thus, when the thermostat is in an open valve state, the coolant is controlled to be at the equilibrium temperature at which the heat release amount by the radiator and various heat absorption amounts are in equilibrium. According to the above configuration, the estimated temperature calculation section calculates the estimated temperature while setting the upper limit value to the equilibrium temperature of the coolant. With this, it is unnecessary to consider the heat release amount at the radiator in calculation of the estimated temperature. This reduces the load on the estimated temperature calculation section.

MODES FOR CARRYING OUT THE INVENTION

With reference to FIGS. 1 to 5, an abnormality determining device for a thermostat according to one embodiment of the present invention will now be described. First, the entire configuration of an engine system on which the abnormality determining device for a thermostat is mounted will be described with reference to FIG. 1.

[Overview of Engine System]

Figure 1:
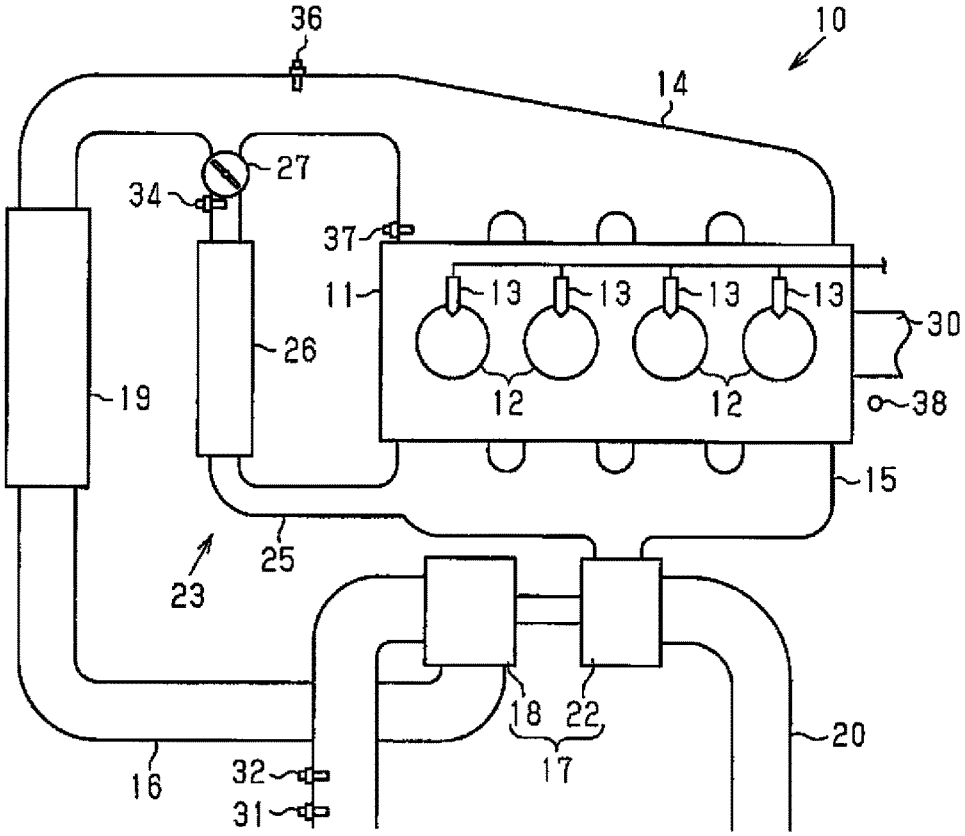
FIG. 1 is a diagram illustrating the general configuration of an engine system on which an abnormality determining device for a thermostat according to one embodiment of the present invention is mounted.

As shown in FIG. 1, the engine system includes a water-cooled engine 10. A plurality of cylinders 12 is formed in the cylinder block 11. Fuel is injected to each cylinder 12 from the corresponding injector 13. The cylinder block 11 is connected to an intake manifold 14 for supplying intake air to each cylinder 12 and an exhaust manifold 15 into which exhaust gas flows from each cylinder 12. A member consisting of the cylinder block 11 and a cylinder head (not shown) is called an engine block.

An air cleaner (not shown), a compressor 18 included in a turbocharger 17, and an intercooler 19 are arranged in order from the upstream side in an intake passage 16, which is connected to the intake manifold 14. A turbine 22, which is coupled to the compressor 18 via a coupling shaft and included in the turbocharger 17, is arranged in an exhaust passage 20, which is connected to the exhaust manifold 15.

The engine system includes an EGR device 23. The EGR device 23 includes an EGR passage 25, which connects the exhaust manifold 15 with the intake passage 16. A water-cooled EGR cooler 26 is arranged in the EGR passage 25. An EGR valve 27 is arranged between the EGR cooler 26 and the intake passage 16 in the EGR passage 25. When the EGR valve 27 is in an open state, some exhaust gas is introduced to the intake passage 16 as EGR gas, and working gas, which is a mixture of exhaust gas and intake air, is supplied to the cylinders 12.

The engine system includes various sensors. An intake air amount sensor 31 and an intake air temperature sensor 32 are located upstream from the compressor 18 in the intake passage 16. The intake air amount sensor 31 detects an intake air amount Ga, which is the mass flow rate of intake air that flows into the compressor 18. The intake air temperature sensor 32 functions as an ambient temperature sensor and detects an intake air temperature Ta, which is the temperature of intake air, as an ambient temperature. An EGR temperature sensor 34 is located between the EGR cooler 26 and the EGR valve 27 in the EGR passage 25 and detects an EGR cooler outlet temperature $T_{egrc}$, which is the temperature of EGR gas that flows into the EGR valve 27. A boost pressure sensor 36 is located between the intake manifold 14 and the connection of the intake passage 16 with the EGR passage 25 and detects a boost pressure Pb, which is the pressure of working gas. A working gas temperature sensor 37 is arranged in the intake manifold 14 and detects a working gas temperature Tim, which is the temperature of working gas that flows into the cylinders 12. An engine speed sensor 38 detects an engine speed Ne, which is the rotation number of a crankshaft 30.

[Cooling Circuit]

With reference to FIG. 2, the overview of the cooling circuit of the engine system will now be described.

Figure 2A:
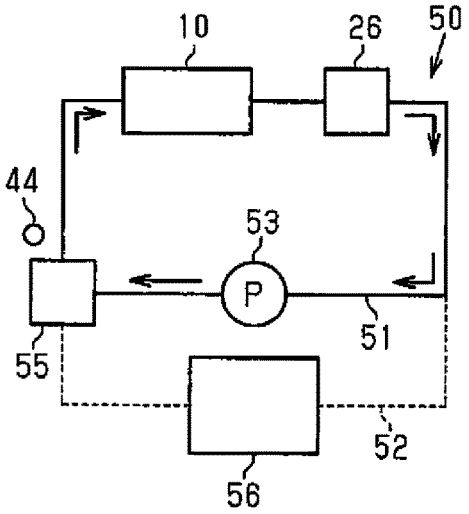
FIG. 2A is a schematic diagram illustrating the circuit structure of a cooling circuit in the engine system and indicates the flow of coolant when a thermostat is in a closed state.
Figure 2B:
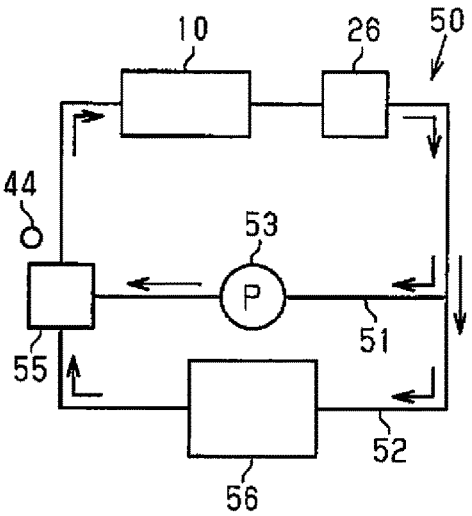
FIG. 2B is a schematic diagram illustrating the circuit structure of the cooling circuit in the engine system and indicates the flow of coolant when the thermostat is in an open state.

As shown in FIGS. 2A and 2B, the cooling circuit 50 includes a first cooling circuit 51 and a second cooling circuit 52. The first cooling circuit 51 includes a pump 53, which pushes coolant by driving force of the engine 10. The second cooling circuit 52 is connected to sections of the first cooling circuit that are upstream and downstream from the pump 53. The cooling circuit 50 includes a thermostat 55 at the connection between the first cooling circuit 51 and the second cooling circuit 52.

The first cooling circuit 51 includes coolant passages formed in the engine 10 and the EGR cooler 26 and is a circuit through which the coolant is circulated by operation of the pump 53. The second cooling circuit 52 has a radiator 56 for cooling the coolant. The thermostat 55 opens its valve when the temperature of the coolant is higher than or equal to a valve opening temperature and allows the coolant to flow into the radiator 56. The valve opening temperature is higher than or equal to a warm-up completion temperature T1, at which it is determined that warm-up of the engine 10 is completed.

When the thermostat 55 is in a closed valve state, the coolant circulates through the first cooling circuit 51 as shown in FIG. 2A. The temperature of the coolant is increased by cooling the engine 10 and EGR gas. In contrast, when the thermostat 55 is in an open valve state, the coolant circulates through the first cooling circuit 51 and the second cooling circuit 52 as shown in FIG. 2B. The temperature of the coolant is decreased by being cooled by the radiator 56. The thermostat 55 operates such that the heat release amount by the radiator 56 and the various heat absorption amounts are in equilibrium. Thus, when the thermostat 55 is in the open valve state, the temperature of the coolant is controlled at the equilibrium temperature $Tc_{thm}$, at which the heat release amount by the radiator 56 and the various heat absorption amounts are in equilibrium. The equilibrium temperature $Tc_{thm}$ is set based on the results of experiments performed in advance using an actual device. In addition, the cooling circuit 50 includes a coolant temperature sensor 44, which detects a coolant temperature Tw, which is the temperature of the coolant that has passed through the thermostat 55.

[Abnormality Determining Device for Thermostat]

Figure 3:
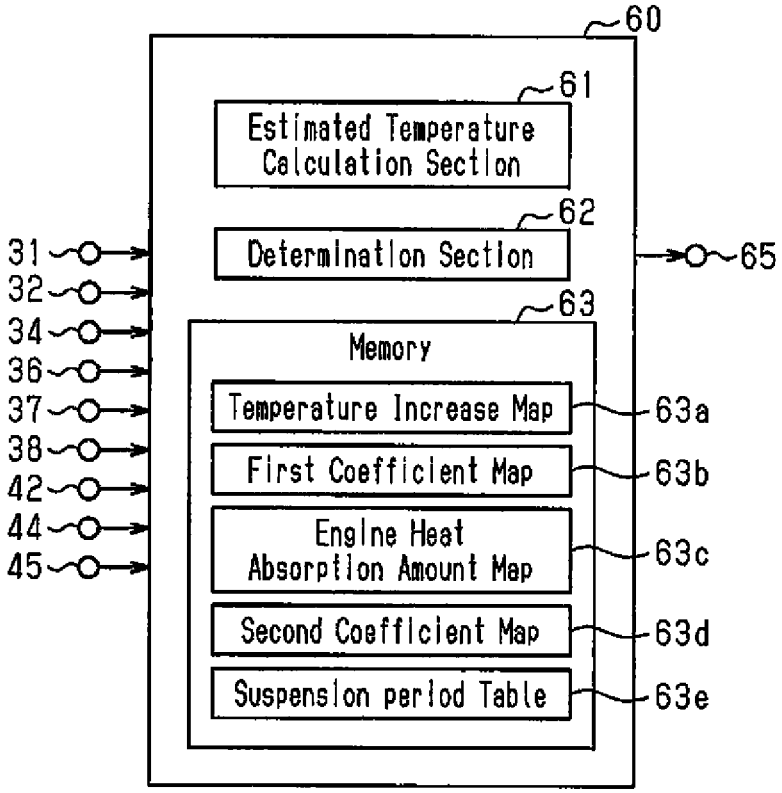
FIG. 3 is the general arrangement of the abnormality determining device for a thermostat.
Figure 4:
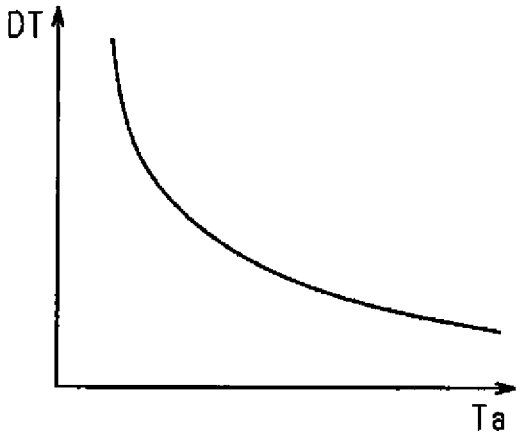
FIG. 4 is a graph schematically illustrating a suspension period table.

With reference to FIGS. 3 to 5, the abnormality determining device for a thermostat (hereinafter, referred to as simply the abnormality determining device) that determines whether the thermostat 55 is stuck open will now be described.

As shown in FIG. 3, the abnormality determining device 60 is mainly configured by a microcomputer. In addition to signals from each sensor, the abnormality determining device 60 receives a signal indicating a fuel injection amount Gf, which is a mass flow rate of fuel, from a fuel injection controlling section 42, which controls fuel injection, a signal indicating a vehicle speed v from a vehicle speed sensor 45, and the like. The abnormality determining device 60 determines whether the thermostat 55 is stuck open after the completion of warm-up of the engine 10 based on various programs and various types of data such as an engine heat absorption amount map 63*c*, which are stored in a memory 63. The abnormality determining device 60 lights an alarm lamp 65 (malfunction indication lamp: MIL) to notify the driver that the engine system is abnormal when detecting that the thermostat 55 is stuck open.

The abnormality determining device 60 includes an estimated temperature calculation section 61 (hereinafter, referred to as simply a calculation section 61) and a determination section 62. The calculation section 61 calculates an estimated temperature Tc, which is an estimation value of the coolant temperature Tw. The determination section 62 determines whether the thermostat 55 is stuck open based on the estimated temperature Tc and the coolant temperature Tw.

[Estimated Temperature Calculation Section 61]

The calculation section 61 calculates an estimated temperature Tc while setting the upper limit value to the equilibrium temperature $Tc_{thm}$ of the coolant by performing the calculation of the expression (1) shown below based on signals from various sensors. In the expression (1), $Tc_{i-1}$ is a previous value of the estimated temperature Tc. Its initial value is the coolant temperature Tw at the start of the engine 10. Dq/dt is a calculation result of the expression (2) shown below and a heat balance q of the coolant for infinitesimal time dt. C is a value obtained by adding the heat capacity of the coolant to the heat capacity of the engine block. In the expression (2), the cylinder heat absorption amount $q_{cyl}$ is a heat transfer amount from combusted gas to the inner walls of the cylinders 12. The EGR cooler heat absorption amount $q_{egr}$ is the absorption amount of the coolant at the EGR cooler 26. The engine heat absorption amount $q_{eng}$ is a heat absorption amount that results from, for example, friction between the inner walls of the cylinders 12 and pistons, adiabatic compression of working gas in the cylinders 12, and the like. The block heat release amount $q_{blk}$ is a heat release amount from the engine block to the ambient air. Various calculations performed by the calculation section 61 will now be described.

$$T_{Ci} = T_{ci-1} + \int \frac{dq}{dt}\frac{1}{C}\ T_{ci} \le T_{cthm} \tag{1}$$

$$\frac{dq}{dt} = \frac{dq_{cyl}}{dt} + \frac{dq_{egr}}{dt} + \frac{dq_{eng}}{dt} - \frac{dq_{blk}}{dt} \tag{2}$$

[Cylinder Heat Absorption Amount $q_{cyl}$ for Infinitesimal Time dt]

In calculation of the cylinder heat absorption amount $q_{cyl}$, the calculation section 61 calculates a working gas amount Gwg, which is the mass flow rate of working gas supplied to the cylinders 12, and a working gas density ρim, which is the density of the working gas. The calculation section 61 calculates the working gas amount Gwg and the working gas density ρim by performing a predetermined calculation based on the equation of state, P×V=Gwg×R×T, using the boost pressure Pb, the engine speed Ne, the exhaust amount D of the engine 10, and the working gas temperature Tim.

In addition, the calculation section 61 calculates an exhaust gas temperature $T_{exh}$, which is the temperature of exhaust gas inside the exhaust manifold 15. The calculation section 61, as indicated by the expression (3), calculates the temperature increase value when the mixture of fuel injection amount Gf/working gas amount Gwg combusts under the engine speed Ne and calculates the exhaust gas temperature $T_{exh}$ by adding the working gas temperature Tim to the temperature increase value. The calculation section 61 calculates the temperature increase value from a temperature increase map 63*a*, which is stored in the memory 63. The temperature increase map 63*a* is a map that defines the temperature increase value for each engine speed Ne and each fuel injection amount Gf/working gas amount Gwg based on the results of experiments or simulations performed in advance using an actual device.

$$T_{exh} = f\left(N_e, \frac{G_f}{G_{wg}}\right) + T_{im} \tag{3}$$

In addition, the calculation section 61, as indicated by the expression (4), calculates a first heat transfer coefficient $h_{cyl}$, which indicates how easily combustion gas heat is transferred to the inner walls of the cylinders 12 based on the engine speed Ne, the fuel injection amount Gf, and the working gas density ρim. The calculation section 61 calculates the first heat transfer coefficient $h_{cyl}$ from a first coefficient map 63*b*, which is stored in the memory 63. The first coefficient map 63*b* is a map that defines the first heat transfer coefficient $h_{cyl}$ for each engine speed Ne, the fuel injection amount Gf, and the working gas density ρim based on the results of experiments or simulations performed in advance using an actual device. In the expression (4), the engine speed Ne is a parameter of the average speed of the pistons; the fuel injection amount Gf is a parameter of injection pressure of fuel; and the working gas density ρim is a parameter of the exhaust velocity of exhaust gas from the cylinders 12.

$$h_{cyl}=f(N_g,G_f,\rho_{im}) \tag{4}$$

The calculation section 61, as indicated by the expression (5), calculates the cylinder heat absorption amount $q_{cyl}$ for infinitesimal time dt by multiplying the first heat transfer coefficient $h_{cyl}$ and the surface area $A_{cyl}$ of the cylinders 12 by the temperature difference between an exhaust temperature $T_{exh}$ and the previous value $Tc_{i-1}$ of the estimated temperature. The cylinder heat absorption amount $q_{cyl}$ is a heat exchanging amount between combustion gas and the inner walls of the cylinders 12. The surface area of each cylinder 12 is the surface area of a cylindrical body of which the diameter is the bore diameter of the cylinder 12 and the height is the stroke of the piston.

$$\frac{dq_{cyl}}{dt} = A_{cyl} \cdot h_{cyl} \cdot (T_{exh} - T_{ci-1}) \tag{5}$$

[EGR Cooler Heat Absorption Amount $q_{egr}$ for Infinitesimal Time dt]

In calculation of the EGR cooler heat absorption amount $q_{egr}$, the calculation section 61 calculates an EGR amount $G_{egr}$ by subtracting an intake air amount Ga from the working gas amount Gwg. The calculation section 61 calculates, as indicated by the expression (6), the EGR cooler heat absorption amount $q_{egr}$ for infinitesimal time dt by multiplying the EGR amount $G_{egr}$ and the specific heat at constant volume Cv of exhaust gas by the temperature difference between the exhaust temperature $T_{exh}$ and the EGR cooler outlet temperature $T_{egrc}$.

$$\frac{dq_{egr}}{dt} = G_{egr} \cdot C_v \cdot (T_{exh} - T_{egrc}) \tag{6}$$

[Engine Heat Absorption Amount $q_{eng}$ for Infinitesimal Time dt]

As indicated by the expression (7), the calculation section 61 calculates the engine heat absorption amount $q_{eng}$ having the engine speed Ne as a parameter. The calculation section 61 calculates the engine heat absorption amount $q_{eng}$ for infinitesimal time dt from the engine heat absorption amount map 63*c*, which is stored in the memory 63. The engine heat absorption amount map 63*c* is a map that defines the engine heat absorption amount $q_{eng}$ for infinitesimal time dt for each engine speed Ne based on the results of experiments or simulations performed in advance using an actual device.

$$\frac{dq_{eng}}{dt} = f(N_e) \tag{7}$$

[Block Heat Release Amount $q_{blk}$ for Infinitesimal Time dt]

In calculation of the block heat release amount $q_{blk}$, as indicated by the expression (8), the calculation section 61 calculates a second heat transfer coefficient $h_{blk}$, which indicates how easily heat is transferred between the engine block and the ambient air, based on the vehicle speed v. The calculation section 61 calculates the second heat transfer coefficient $h_{blk}$ from a second coefficient map 63*d*, which is stored in the memory 63. The second coefficient map 63*d* is a map that defines the second heat transfer coefficient $h_{blk}$ for each vehicle speed v based on the results of experiments or simulations performed in advance using an actual device. As indicated by the expression (9), the calculation section 61 calculates the block heat release amount $q_{blk}$ for infinitesimal time dt by multiplying the surface area $A_{blk}$ of the engine block and the second heat transfer coefficient $h_{blk}$ by the temperature difference between the previous value $Tc_{i-1}$ of the estimated temperature Tc and the intake air temperature Ta. The surface area $A_{blk}$ of the engine block is an area obtained by removing the backside surface in the advancing direction from the entire surface of the engine block, that is, a total area of the front portion and the side portion. Travelling wind directly blows to the front portion, and the relative wind flows on the surface of the side portion in a direction opposite to the advancing direction.

$$h_{blk} = f(v) \tag{8}$$

$$\frac{dq_{blk}}{dt} = A_{blk} \cdot h_{blk} \cdot (T_{ci-1} - T_c) \tag{9}$$

The calculation section 61, which has calculated the various types of heat amounts, calculates the estimated temperature Tc by adding, to the previous value $Tc_{i-1}$, a value obtained by dividing the heat balance q by the heat capacity C as a temperature change amount according to the above expression (1). As shown in the expression (1), the calculation section 61 calculates the estimated temperature Tc while setting the upper limit value to the equilibrium temperature $Tc_{thm}$ of the coolant. Thus, for example, when the previous value $Tc_{i-1}$ is the equilibrium temperature $Tc_{thm}$, the estimated temperature Tc is maintained to be the equilibrium temperature $Tc_{thm}$ if the heat balance is positive, and the estimated temperature Tc is lower than the equilibrium temperature $Tc_{thm}$ if the heat balance q is negative. The heat balance q has a positive value when the engine 10 is in a normal traveling state, and the heat balance q has a negative value, for example, when the engine is in an idling state in a cold area or in a low load, low rotation state at a downslope. Hereinafter, the state in which the heat balance q has a negative value is called a heat release state.

[Determination Section 62]

The determination section 62 determines whether the thermostat 55 is stuck open based on the estimated temperature Tc, which is the calculation result of the calculation section 61 after completion of warm-up of the engine 10, and the coolant temperature Tw, which is the detection value of the coolant temperature sensor 44.

The determination section 62 sets a value of a flag F1 that indicates whether to allow or prohibit determination about stuck-open state of the thermostat 55 based on the estimated temperature Tc. The determination section 62 sets the value of the flag F1 to 0 when the estimated temperature Tc is lower than or equal to the stuck-open state determination temperature T2 and prohibits determination about stuck-open state of the thermostat 55. The determination section 62 sets the value of the flag F1 to 1 and allows determination about the stuck-open state of the thermostat 55 when the estimated temperature Tc is higher than the stuck-open state determination temperature T2.

The determination section 62 sets the value of the flag F2, which indicates an abnormality of the coolant temperature Tw, based on the coolant temperature Tw. After completion of warm-up, the determination section 62 changes the value of the flag F2 to 1 from 0 when a state in which the coolant temperature Tw is lower than or equal to the stuck-open state determination temperature T2 has continued for a suspension period DT. The determination section 62 changes the value of the flag F2 to 0 from 1 if the coolant temperature Tw is higher than the stuck-open state determination temperature T2. In other words, the suspension period DT indicates suspension when the value of the flag F2 is changed to 1 from 0. The determination section 62 sets the suspension period DT based on a suspension period table 63*e*, which is stored in the memory 63.

As shown in FIG. 4, the suspension period table 63*e* defines the suspension period DT for each intake air temperature Ta. The suspension period DT is a value based on the results of experiments or simulations performed in advance using an actual device. The lower the intake air temperature Ta, the longer the suspension period DT becomes. This is based on the fact that the coolant temperature Tw does not easily increase because the lower the ambient temperature, the greater the block heat release amount $q_{blk}$ becomes. The determination section 62 sets the suspension period DT by selecting the suspension period DT from the suspension period table 63*e*.

When the thermostat 55 is normal and the state is not in the aforementioned heat release state, it is unlikely that the coolant temperature Tw will decrease to a temperature lower than or equal to the stuck-open state determination temperature T2 after completion of warm-up. Even when the coolant temperature Tw decreases to a temperature lower than or equal to the stuck-open state determination temperature T2, the coolant temperature Tw will increase to a temperature higher than the stuck-open state determination temperature T2 in a short period. Thus, if it is detected that the thermostat 55 is stuck open only on the condition that the coolant temperature Tw is lower than or equal to the stuck-open state determination temperature T2 while the value of the flag F1 is 1, the reliability of the determination result of the abnormality determining device 60 is reduced.

In contrast, the determination section 62 detects that the thermostat 55 is stuck open on the condition that a state in which the value of the flag F1 is 1 and the value of the flag F2 is 1 has continued for a determination period JT. This increases the reliability of the determination result of the abnormality determining device 60. The determination section 62 sets the suspension period DT and maintains the value of the flag F2 to be 0 when the coolant temperature Tw becomes a temperature higher than the stuck-open state determination temperature T2 in the suspension period DT. In other words, the determination section 62 does not change the value of the flag F2 to 1 from 0 until the coolant temperature Tw has remained at a temperature lower than or equal to the stuck-open state determination temperature T2 for the suspension period DT. This further increases the reliability of the determination result of the abnormality determining device 60.

The lower the intake air temperature Ta, the greater the block heat release amount $q_{blk}$ becomes. Thus, the lower the intake air temperature Ta, the more easily the coolant temperature Tw decreases and the less easily the coolant temperature Tw increases. Thus, the lower the intake air temperature Ta, the longer the suspension period DT is set. This allows for determination of whether the thermostat 55 is stuck open under the condition suitable for the intake air temperature Ta. As a result, the thermostat 55 is unlikely to be erroneously detected to be stuck open. Thus, the reliability of the determination result of the abnormality determining device 60 is increased.

[Operation]

With reference to FIG. 5, operation of the abnormality determining device 60 will now be described taking, as an example, a case in which the coolant temperature Tw decreases to a temperature lower than or equal to the stuck-open state determination temperature T2 after completion of warm-up. At the start of the engine 10, the values of the flag F1 and the flag F2 are 0, and the alarm lamp 65 is turned off.

Figure 5A:
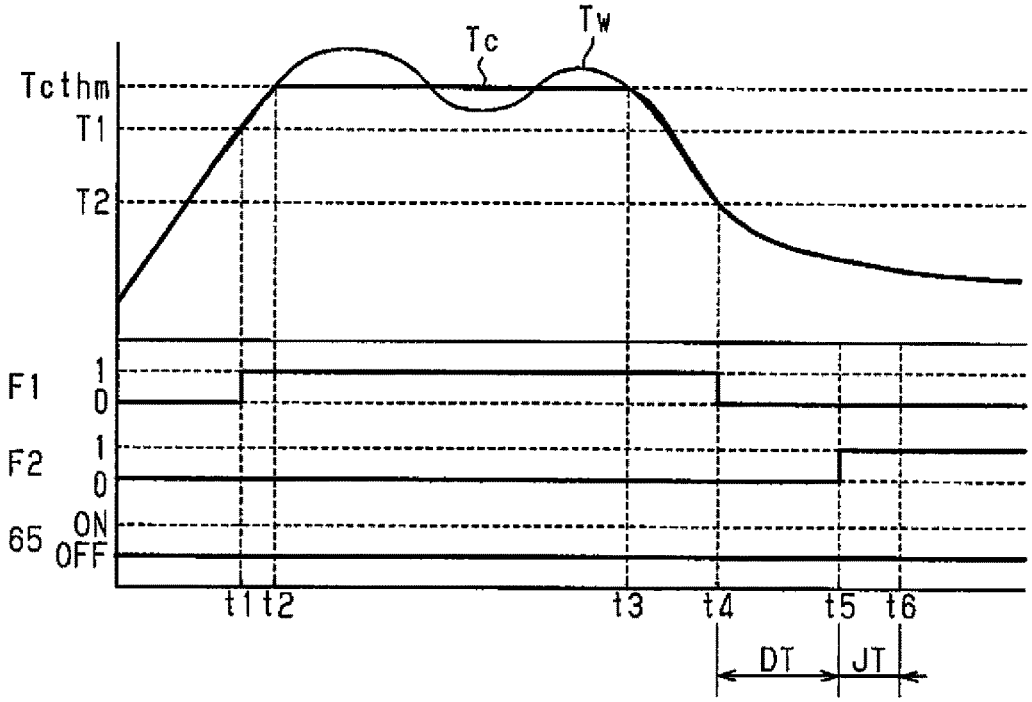
FIG. 5A is a timing chart illustrating the relationship between changes in various temperatures and flags and illustrating an example in which the thermostat is normal.

With reference to FIG. 5A, a case in which the thermostat 55 is normal will now be described.

As shown in FIG. 5A, upon the start of the engine 10, the coolant temperature Tw and the estimated temperature Tc both increase. When warm-up of the engine 10 is completed at time t1, the coolant temperature Tw and the estimated temperature Tc reach the warm-up completion temperature T1. At this time, the determination section 62 changes the value of the flag F1 to 1 from 0.

The coolant temperature Tw reaches the valve opening temperature of the thermostat 55 between time t1 and time t2. When the coolant temperature Tw reaches the valve opening temperature, the thermostat 55 opens the valve, and the radiator 56 starts cooling coolant.

The engine 10 after completion of warm-up is in a normal traveling state from time t2 to the next time t3. The thermostat 55 is repeatedly opened and closed according to the coolant temperature Tw, and the coolant temperature Tw is maintained to be about the equilibrium temperature $Tc_{thm}$. In the period from time t2 to t3, the heat balance q has a positive value. Thus, the calculation section 61 calculates the estimated temperature Tc to be the equilibrium temperature $Tc_{thm}$.

If the thermostat 55 is normal at subsequent time t4, or when the coolant temperature Tw becomes a temperature lower than or equal to the stuck-open state determination temperature T2, the engine 10 is in the heat release state in a period from time t3 to time t4. Thus, after time t3, the coolant temperature Tw and the estimated temperature Tc both decrease. At time t4, the coolant temperature Tw and the estimated temperature Tc both become a temperature lower than or equal to the stuck-open state determination temperature T2. Since the coolant temperature Tw becomes a temperature lower than or equal to the stuck-open state determination temperature T2 at time t4, the determination section 62 sets the suspension period DT starting from time t4, according to the intake air temperature Ta. Further, the determination section 62 changes the value of the flag F1 to 0 from 1 to prohibit determination about the stuck-open state of the thermostat 55 since the estimated temperature Tc becomes a temperature lower than or equal to the stuck-open state determination temperature T2. The determination section 62 then changes the value of the flag F2 to 1 from 0 when a state in which the coolant temperature Tw is lower than or equal to the stuck-open state determination temperature T2 has continued until time t5, at which the suspension period DT has elapsed. The determination section 62 determines that the thermostat 55 is normal on the condition that a state in which the value of the flag F1 is 0 and the value of the flag F2 is 1 has continued from time t5 to t6, at which the determination period JT has elapsed.

Figure 5B:
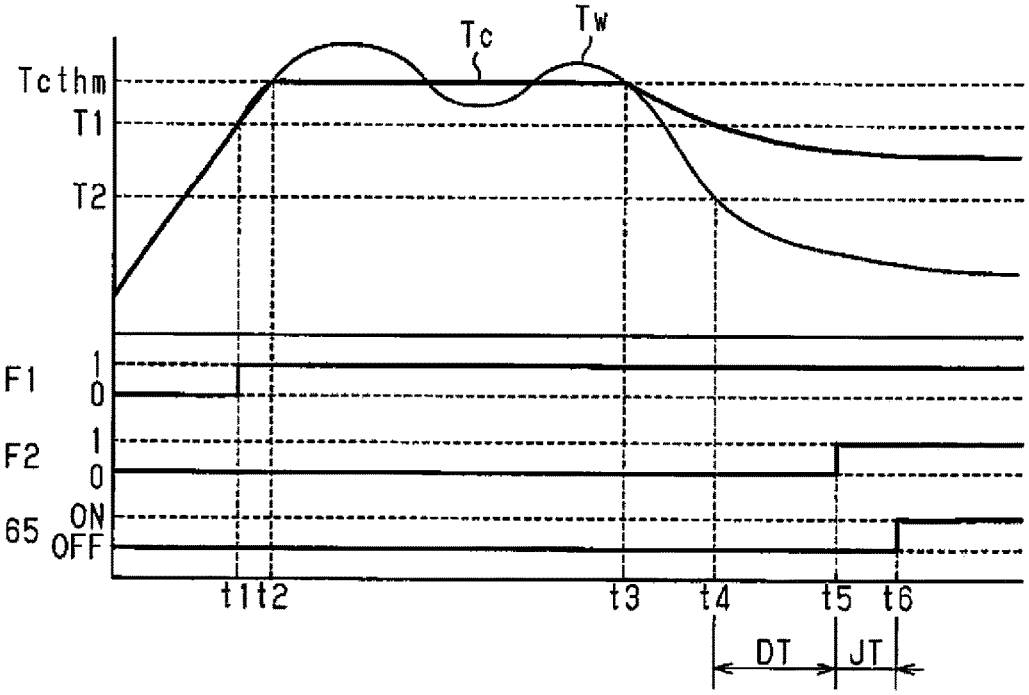
FIG. 5B is a timing chart illustrating the relationship between changes in various temperatures and flags and illustrating an example in which the thermostat is stuck open.

Next, with reference to FIG. 5B, a case in which the thermostat 55 is stuck open will now be described. For example, it is assumed that the thermostat 55 is stuck open immediately before time t3 after each temperature has shifted in a manner similar to FIG. 5A. In this case, as shown in FIG. 5B, after time t3, even when the coolant temperature Tw is lower than the valve opening temperature of the thermostat 55, the coolant continues to flow to the radiator 56. Since the estimated temperature Tc is calculated without considering the heat release amount at the radiator 56, the estimated temperature Tc shifts without being influenced by the stuck-open state of the thermostat 55. Thus, at time t4, only the coolant temperature Tw decreases to a temperature lower than or equal to the stuck-open state determination temperature T2. In addition, after time t4, since the value of the flag F1 is maintained to be 1, the determination as to whether the thermostat 55 is stuck open remains allowed.

At time t4, the determination section 62 sets the suspension period DT according to the intake air temperature Ta at time t4 as a start point. The determination section 62 then changes the value of the flag F2 to 1 from 0 when a state in which the coolant temperature Tw is lower than or equal to the stuck-open state determination temperature T2 continues until time t5 at which the suspension period DT has elapsed. The determination section 62 determines that the thermostat 55 is stuck open on the condition that a state in which the value of the flag F1 is 1 and the value of the flag F2 is 1 continues from time t5 to time t6, at which the determination period JT has elapsed. The determination section 62 then lights the alarm lamp 65.

The abnormality determining device 60 according to the embodiment achieves the following advantages.

(1) Determination of whether the thermostat 55 is stuck open is possible based on the estimated temperature Tc and the coolant temperature Tw even after completion of warm-up.

(2) The determination section 62 detects that the thermostat 55 is stuck open on the condition that the coolant temperature Tw is lower than or equal to the stuck-open state determination temperature T2 and a state in which the estimated temperature Tc is higher than the stuck-open state determination temperature T2 continues for the suspension period DT and the determination period JT. As a result, erroneous determination of a stuck-open state of the thermostat 55 is limited, so that the reliability of the determination result of the abnormality determining device 60 is increased.

(3) The lower the intake air temperature Ta, the longer the suspension period DT becomes. This increases the reliability of the determination result of the abnormality determining device 60.

(4) The estimated temperature Tc is calculated based on the heat balance q of the cylinder heat absorption amount $q_{cyl}$, the EGR cooler heat absorption amount $q_{egr}$, the engine heat absorption amount $q_{eng}$, and the block heat release amount $q_{blk}$. This increases the accuracy of the estimated temperature Tc.

(5) The calculation section 61 calculates the estimated temperature Tc while setting the upper limit value to the equilibrium temperature $Tc_{thm}$. Such configuration eliminates the need to consider a heat release amount from the radiator 56 while the thermostat 55 opens the valve. As a result, the load on the calculation section 61 is reduced in calculation of the estimated temperature Tc. In addition, for example, the configuration for obtaining the heat release amount at the radiator 56 is unnecessary. This reduces the number of components of the abnormality determining device 60.

(6) As a parameter related to the exhaust velocity of exhaust gas from the cylinders 12, it is preferable to use the density of exhaust gas in the exhaust manifold 15, which is the destination of exhaust gas flowing out, in place of the working gas density ρim. However, an additional sensor that has good durability to the temperature and constituents of exhaust gas is needed. In this regard, using the working gas density ρim as a parameter related to the exhaust velocity of exhaust gas from the cylinders 12 allows an existing sensor mounted in the engine system to be used. As a result, the number of components and the costs are reduced in the abnormality determining device 60.

The above illustrated embodiment may be modified in the following forms as necessary.

The calculation section 61 may calculate the heat release amount at the radiator 56 on the condition that the coolant temperature Tw is higher than or equal to the valve opening temperature of the thermostat 55 and calculate the estimated temperature Tc considering the calculated value. The heat release amount at the radiator can be calculated, for example, by providing a temperature sensor for detecting the temperature change amount of the coolant at the radiator 56 in the cooling circuit 50 and based on the temperature change amount, the coolant amount, and the heat capacity of the coolant.

The calculation section 61 may calculate the first heat transfer coefficient $h_{cyl}$ using the density of exhaust gas in the exhaust manifold 15 instead of the working gas density ρim. Such configuration increases the accuracy of the first heat transfer coefficient $h_{cyl}$. As a result, the accuracy of the estimated temperature Tc is increased. The density of the exhaust gas can be obtained, for example, from the pressure and the temperature inside the exhaust manifold 15.

The calculation section 61 may calculate the EGR cooler heat absorption amount $q_{egr}$ based on the difference between the EGR cooler outlet temperature $T_{egrc}$ and the detection value of a temperature sensor for detecting the temperature of EGR gas that flows into the EGR cooler 26.

The suspension period DT may be a constant time regardless of the intake air temperature Ta.

The determination section 62 may set the value of the flag F2 to 1 when the coolant temperature Tw becomes a temperature lower than or equal to the warm-up completion temperature T1 without setting the suspension period DT.

The above embodiment calculates the estimated temperature Tc while setting the upper limit value to the equilibrium temperature $Tc_{thm}$. The embodiment is not limited to this. The upper limit value of the estimated temperature Tc may be set to a temperature lower than the equilibrium temperature $Tc_{thm}$. For example, the temperature may be the valve opening temperature of the thermostat 55 or a temperature at which the opening degree of the thermostat 55 is 50%. With such a configuration, the estimated temperature Tc can be calculated according to the characteristics of the thermostat 55. Further, the value of the flag F1 is easily set to be 0 by setting the upper limit value of the estimated temperature Tc to a temperature lower than the equilibrium temperature $Tc_{thm}$. As a result, the reliability of the determination result is further increased.

The engine 10 may be a diesel engine, a gasoline engine, or a natural gas engine. The alarm lamp 65 may be, for example, an alarm sound generation section that generates alarm sound.

The invention claimed is:

1. An abnormality determining device for a thermostat comprising:

a coolant temperature sensor that detects a temperature of coolant for cooling an engine;

an estimated temperature calculation section that calculates an estimated temperature, which is an estimated value of the temperature of the coolant; and a determination section that determines that the thermostat is stuck open after completion of warm-up of the engine, wherein the determination section determines that the thermostat is stuck open on condition that the estimated temperature has been higher than a stuck-open state determination temperature that is lower than a warm-up completion temperature, which indicates completion of warm-up of the engine, a state in which a coolant temperature, which is a detection value of the coolant temperature sensor, has been lower than or equal to the stuck-open state determination temperature continues for a determination period, and the estimated temperature calculation section calculates the estimated temperature while setting an upper limit value to an equilibrium temperature of the coolant when the thermostat is in an open valve state.

2. The abnormality determining device for a thermostat according to claim 1, wherein the determination section has a suspension period for determining whether the condition is met, and the suspension period is a period for which the estimated temperature is higher than the stuck-open state determination temperature and the coolant temperature continues to be lower than or equal to the stuck-open state determination temperature.

3. The abnormality determining device for a thermostat according to claim 2, further comprising an ambient temperature sensor that detects an ambient temperature, wherein the determination section holds a suspension period table that defines the suspension period for each ambient temperature and sets the suspension period according to the ambient temperature based on the suspension period table, and the suspension period table defines the suspension period such that the lower the ambient temperature, the longer the suspension period becomes.

4. The abnormality determining device for a thermostat according to claim 1, wherein the engine has an EGR device that causes some exhaust gas to circulate through an intake passage as EGR gas, the EGR device has an EGR cooler that cools the EGR gas with the coolant, the estimated temperature calculation section:

calculates a cylinder heat absorption amount, which is a heat absorption amount based on an engine speed, a fuel injection amount, an amount of working gas introduced to cylinders, a temperature of the working gas, and one of a density of the working gas and a density of exhaust gas in an exhaust manifold;

calculates an EGR cooler heat absorption amount, which is a heat absorption amount based on a mass flow rate of the EGR gas and temperature change of the EGR gas in the EGR cooler;

calculates an engine heat absorption amount, which is a heat absorption amount based on the engine speed; and calculates a block heat release amount, which is a heat release amount from an engine block based on a vehicle speed, an ambient temperature, a previous estimated temperature, and a surface area of the engine block, the estimated temperature calculation section calculates heat balance based on the cylinder heat absorption amount, the EGR cooler heat absorption amount, the engine heat absorption amount, and the block heat release amount, and the estimated temperature calculation section calculates a temperature change amount of the coolant by dividing the heat balance by a value obtained by adding a heat capacity of the engine block to a heat capacity of the coolant.

* * * * *